US006179276B1

(12) United States Patent
Chen et al.

(10) Patent No.: US 6,179,276 B1
(45) Date of Patent: Jan. 30, 2001

(54) HEAT AND MASS TRANSFER ELEMENT ASSEMBLY

(75) Inventors: Michael M. Chen, Wellsville, NY (US); Carl-Olof Erik Olsson, Vasteras (SE)

(73) Assignee: ABB Air Preheater, Inc., Wellsville, NY (US)

( * ) Notice: Under 35 U.S.C. 154(b), the term of this patent shall be extended for 0 days.

(21) Appl. No.: 09/251,558

(22) Filed: Feb. 17, 1999

(51) Int. Cl.[7] ..... F02M 29/04

(52) U.S. Cl. ..... 261/112.2; 165/133; 165/DIG. 42; 165/10

(58) Field of Search ..... 165/10, 8, 133, 165/DIG. 42; 261/112.2

(56) References Cited

U.S. PATENT DOCUMENTS 4,396,058 * 8/1983 Kurschner ..... 165/8

OTHER PUBLICATIONS

Papers 4, 5 and 6 of thesis entitled "Thermal and Hydraulic Performance of Enhanced Rectangular Tubes for Compact Heat Exchangers" by Carl–Olof Olsson, published Mar. 14, 1997 (ISBN 91–7197–457–1).

Thesis entitled "Thermal and Hydraulic Performance of Enhanced Rectangular Tubes for Compact Heat Exchangers" by Carl–Olof Olsson, published Mar. 14, 1997 (ISBN 91–7197–457–1).

* cited by examiner

*Primary Examiner*—Chester T. Barry
(74) *Attorney, Agent, or Firm*—Alix, Yale & Ristas, LLP

(57) ABSTRACT

A heat transfer assembly for a rotary regenerative air preheater has heat transfer plates which include means for spacing the plates apart to form flow passages and a plurality of rows of V-shaped ribs extending across the flow passages. Alternate rows of V-shaped ribs on each plate protrude outwardly from opposite surfaces of the plate. Several arrangements for aligning the ribs on one plate with the ribs on the adjacent plate are described as are alternate orientations of the adjacent rows of ribs on each plate. The relationship of the height of the ribs to the plate spacing is defined as is the relationship of the rib spacing to the rib height and the plate spacing to the length of the V-shaped rib sections.

8 Claims, 8 Drawing Sheets

HEAT AND MASS TRANSFER ELEMENT ASSEMBLY

BACKGROUND OF THE INVENTION

This invention relates to assemblies of heat and mass transfer plates which provide improved levels of transfer compared to any increase in pressure drop. More particularly, the assemblies have a gas stream flowing in the spaces between adjacent plates whereby heat is transferred between the plates and the fluid and/or the fluid is acted upon by the plates such as a catalytic action to effect mass transfer within the fluid. Most particularly the assemblies are used for heat transfer in rotary regenerative air preheaters or for a substrate for supporting a catalyst for the reduction of No, in a flue gas stream flowing over the plates.

One type of heat exchange apparatus to which the present invention has particular application is the well-known rotary regenerative heater. A typical rotary regenerative heater has a cylindrical rotor divided into compartments in which are disposed and supported spaced heat transfer plates which, as the rotor turns, are alternately exposed to a stream of heating gas and then upon rotation of the rotor to a stream of cooler air or other gaseous fluid to be heated. As the heat transfer plates are exposed to the heating gas, they absorb heat therefrom and then when exposed to the cool air or other gaseous fluid to be heated, the heat absorbed from the heating gas by the heat transfer plates is transferred to the cooler gas. Most heat exchangers of this type have their heat transfer plates closely stacked in spaced relationship to provide a plurality of passageways between adjacent plates for flowing the heat exchange fluid therebetween.

In such a heat exchanger, the heat transfer capability of a heat exchanger of a given size is a function of the rate of heat transfer between the heat exchange fluid and the plate structure. However for commercial devices, the utility of a device is determined not alone by the coefficient of heat transfer obtained, but also by other factors such as cost and weight of the plate structure. Ideally, the heat transfer plates will induce a highly turbulent flow through the passages therebetween in order to increase heat transfer from the heat exchange fluid to the plates while at the same time providing relatively low resistance to flow between the passages and also presenting a surface configuration which is readily cleanable.

To clean the heat transfer plates, it has been customary to provide soot blowers which deliver a blast of high pressure air or steam through the passages between the stacked heat transfer plates to dislodge any particulate deposits from the surface thereof and carry them away leaving a relatively clean surface. One problem encountered with this method of cleaning is that the force of the high pressure blowing medium on the relatively thin heat transfer plates can lead to cracking of the plates unless a certain amount of structural rigidity is designed into the stack assembly of heat transfer plates.

One solution to this problem is to crimp the individual heat transfer plates at frequent intervals to provide double-lobed notches which have one lobe extending away from the plate in one direction and the other lobe extending away from the plate in the opposite direction. Then when the plates are stacked together to form the heat transfer element assembly, these notches serve to maintain adjacent plates so that forces placed on the plates during the soot blowing operation can be equilibrated between the various plates making up the heat transfer element assembly.

A heat transfer element assembly of this type is disclosed in U.S. Pat. No. 4,396,058. In the patent, the notches extend in the direction of the general heat exchange fluid flow, i.e., axially through the rotor. In addition to the notches, the plates are corrugated to provide a series of oblique furrows or undulations extending between the notches at an acute angle to the flow of heat exchange fluid. The undulations on adjacent plates extend obliquely to the line of flow either in an aligned manner or oppositely to each other. Although such heat transfer element assemblies exhibit favorable heat transfer rates, the results can vary rather widely depending upon the specific design and relationship of the notches and undulations.

SUMMARY OF THE INVENTION

An object of the present invention is to provide an improved heat transfer element assembly wherein the thermal performance is optimized to provide a desired level of heat transfer and pressure drop with assemblies having a reduced volume and weight. In accordance with the invention, the heat transfer plates of the heat transfer element assembly have means, such as longitudinal bibbed notches, spacing the plates apart to form the flow passages. The plates have multiple V-shaped ribs on each side in the flow passages aligned to produce longitudinal vortices which, together with specific ranges for the plate spacing in relation to rib parameters produce the optimum thermal performance.

DESCRIPTION OF THE PREFERRED EMBODIMENT

Figure 1:
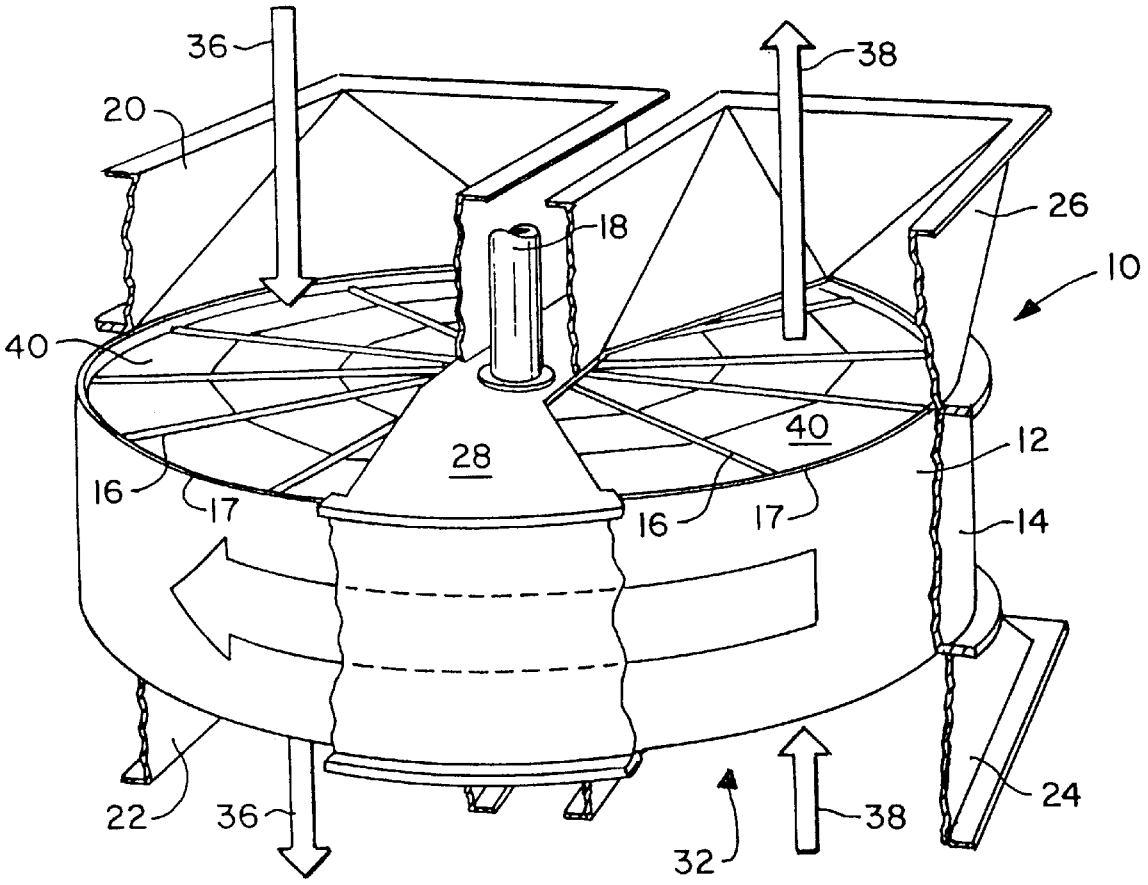
FIG. 1 PRIOR ART
FIG. 1 is a perspective view of a conventional rotary regenerative air preheater which contains heat transfer element assemblies made up of heat transfer plates.

With reference to FIG. 1 of the drawings, a conventional rotary regenerative preheater is generally designated by the numerical identifier 10. The air preheater 10 has a rotor 12 rotatably mounted in a housing 14. The rotor 12 is formed of diaphragms or partitions 16 extending radially from a rotor post 18 to the outer periphery of the rotor 12. The partitions 16 define compartments 17 therebetween for containing heat exchange element assemblies 40.

Figure 2:
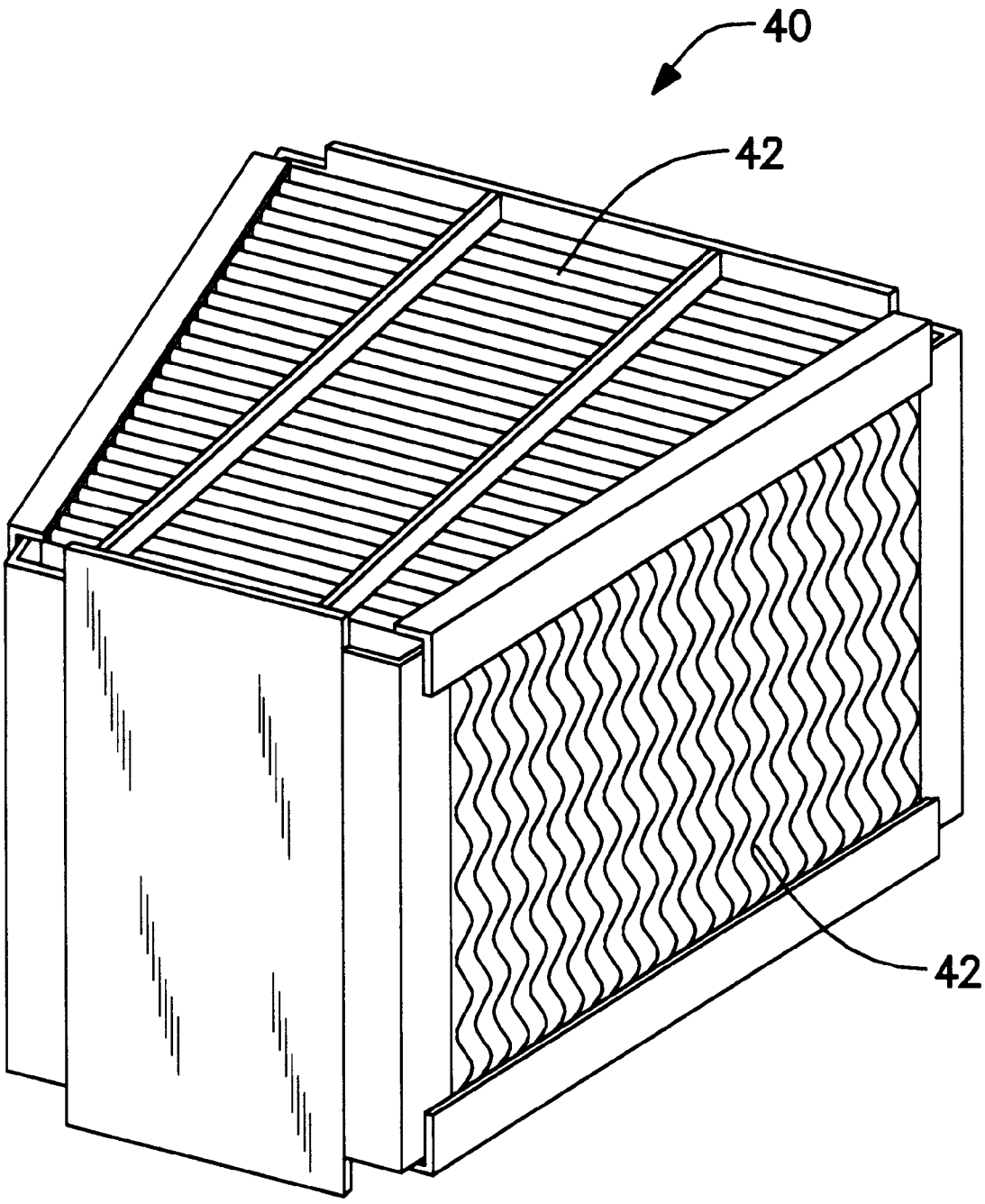
Figure 2 (Prior Art)
FIG. 2 is a perspective view of a conventional heat transfer element assembly showing the heat transfer plates stacked in the assembly.

The housing 14 defines a flue gas inlet duct 20 and a flue gas outlet duct 22 for the flow of hot flue gases through the air preheater 10. The housing 14 further defines an air inlet duct 24 and an air outlet duct 26 for the flow of combustion air through the preheater 10. Sector plates 28 extend across the housing 14 adjacent the upper and lower faces of the rotor 12. The sector plates 28 divide the air preheater 10 into an air sector and a hot flue gas sector. The arrows of FIG. 1indicate the direction of a flue gas stream 36 and an air stream 38 through the rotor 12. The hot flue gas stream 36 entering through the flue gas inlet duct 20 transfers heat to the heat transfer element assemblies 40 mounted in the compartments 17. The heated heat transfer element assemblies 40 are then rotated to the air sector 32 of the air preheater 10. The stored heat of the heat transfer element assemblies 40 is then transferred to the combustion air stream 38 entering through the air inlet duct 24. The cold flue gas stream 36 exits the preheater 10 through the flue gas outlet duct 22, and the heated air stream 38 exits the preheater 10 through the air outlet duct 26. FIG. 2 illustrates a typical heat transfer element assembly or basket 40 showing a general representation of heat transfer plates 42 stacked in the assembly.

Figure 3:
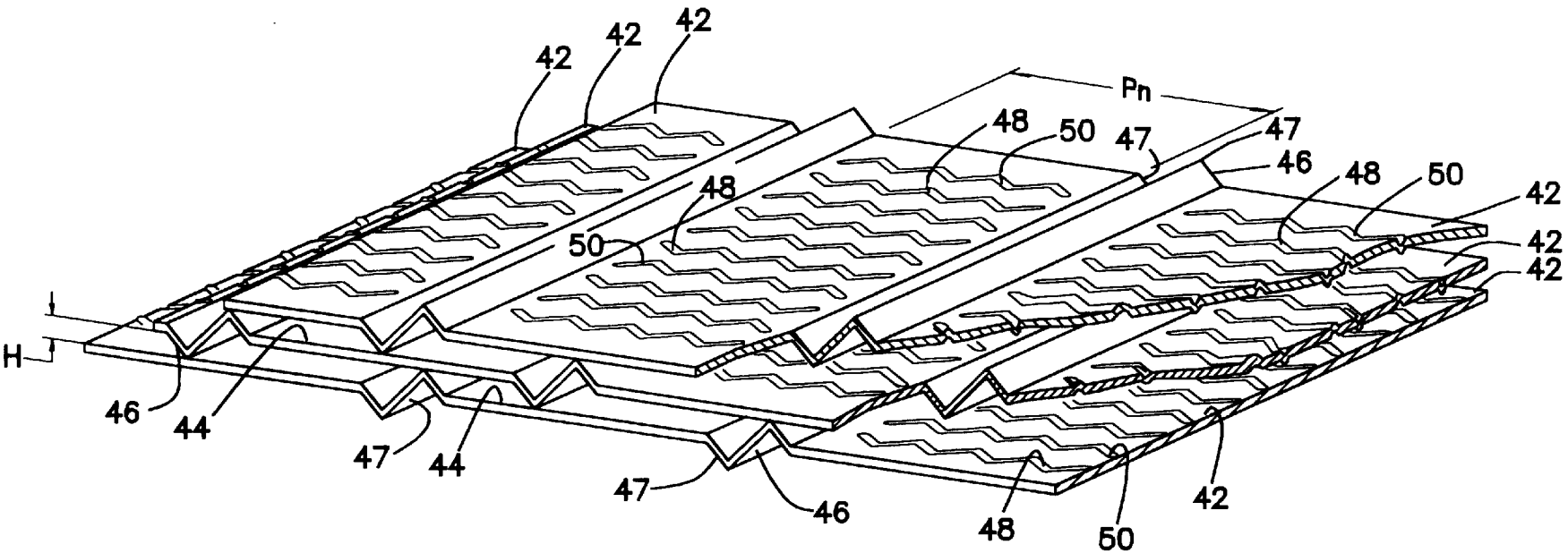
FIG. 3 is a perspective view of portions of three heat transfer plates for a heat transfer element assembly in accordance with the present invention illustrating the spacing of the notches and the V-shaped ribs.

FIG. 3 shows three of the heat transfer plates 42 in perspective formed according to the present invention. The plates are stacked in spaced relationship to provide a plurality of passageways 44 therebetween. These passageways 44 provide the flow path for the heat exchange fluid to provide heat exchange to the plates. Each plate 42 is planar and contains a plurality of parallel, spaced apart notches 46 which are the spacers to maintain adjacent plates a predetermined distance apart as is known in the prior art. These notches 46 are formed by crimping the plates to produce the bibbed notches having the lobes 47 projecting outwardly from the surface of the plate in opposite directions. It is the peaks of the lobes which contact the adjacent plate to maintain the spacing. Such notches are disclosed, for example, in U.S. Pat. No. 4,396,058. Although this FIG. 3 discloses the bibbed notches 46 to space the plates, the invention is not limited to these specific spacers. Any type of spacing means may be employed with this invention. Also, although FIG. 3 shows the notches 46 as being staggered on adjacent plates, such staggering may not be necessary with other forms of spacers.

Figure 4:
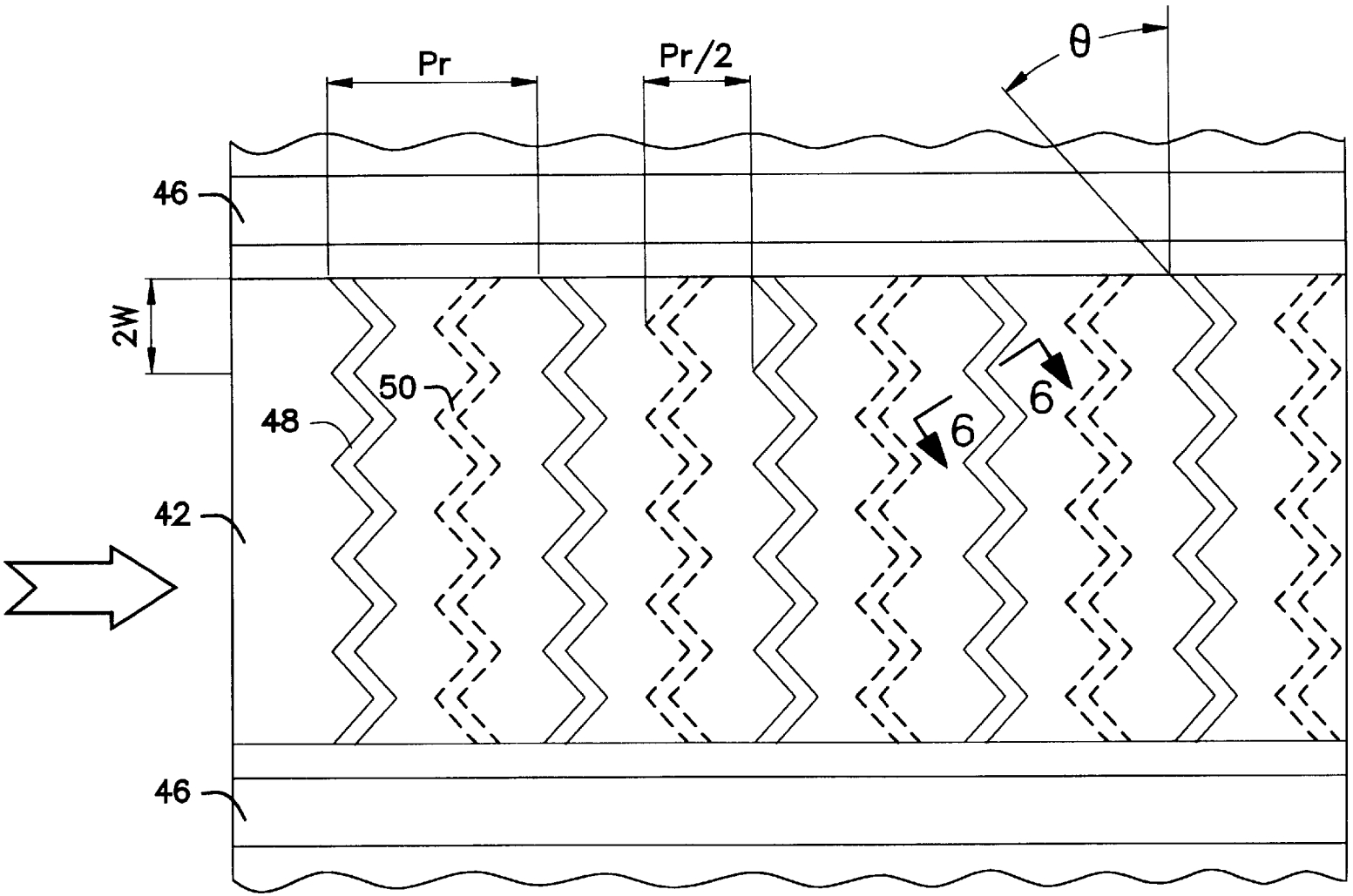
FIG. 4 is a top view of one of the plates of FIG. 3 illustrating the orientation and dimensions of the V-shaped ribs.
Figure 5:
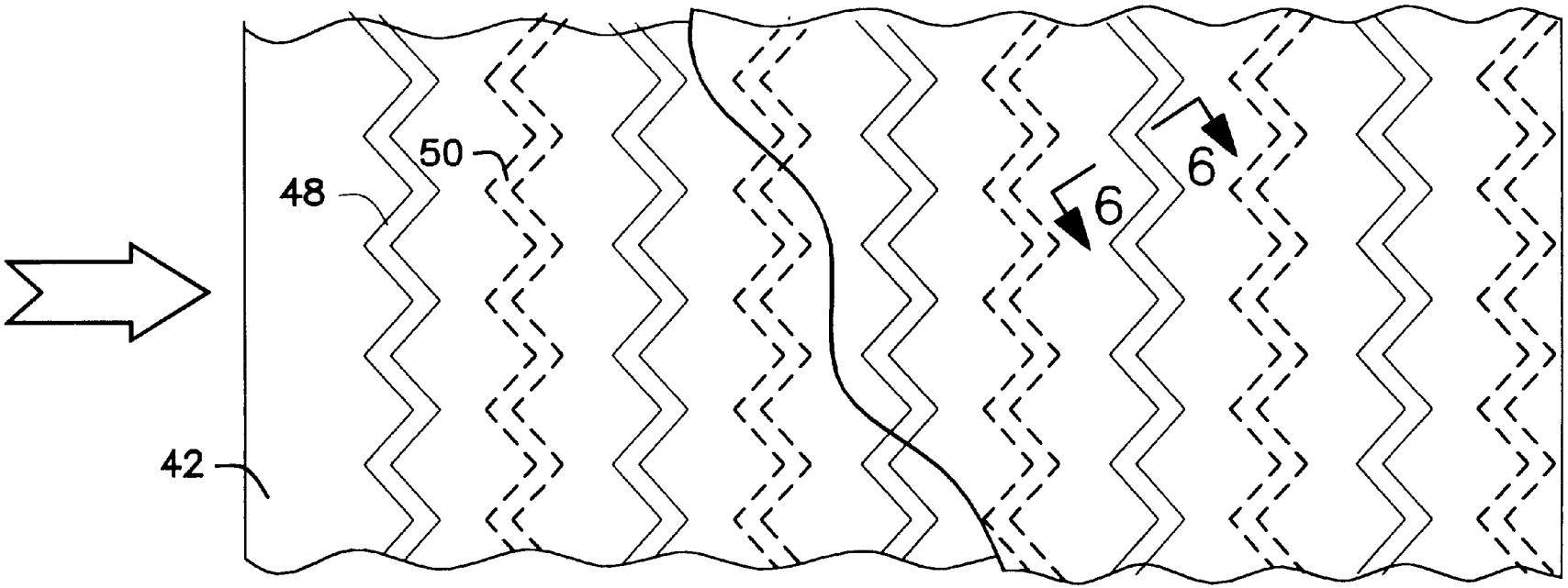
FIG. 5 is a top view of two of the plates of FIG. 4 stacked together to relationship of the V-shaped ribs.

In accordance with the present invention, the plates 42 are formed with multiple V-shaped ribs 48 and 50 protruding from opposed planar surfaces of each plate and extending across the plates from side-to-side and between the notches perpendicular to the flow direction. Each rib will appear as a protrusion on one planar surface of a plate and as an intrusion or indentation on the opposed planar surface of that plate. The multiple V-shaped rib pattern is repeated in the flow direction from end-to-end at a selected pitch (spacing) Pr described later. In between two protruding ribs is an intruding rib which provides the multiple V-shaped rib pattern on the other side of the plate. This is shown in FIG. 3 where the ribs 48 extend upwardly from the plates and the ribs 50 extend downwardly. Each row of V-shaped ribs is comprised of a series of V-shaped rib sections which in turn are each comprised of two generally straight sections forming the V. As shown in FIG. 3 and FIGS. 4 and 5 described below, the V-shaped rib sections of adjacent rows are oriented in opposite directions.

Figure 6:
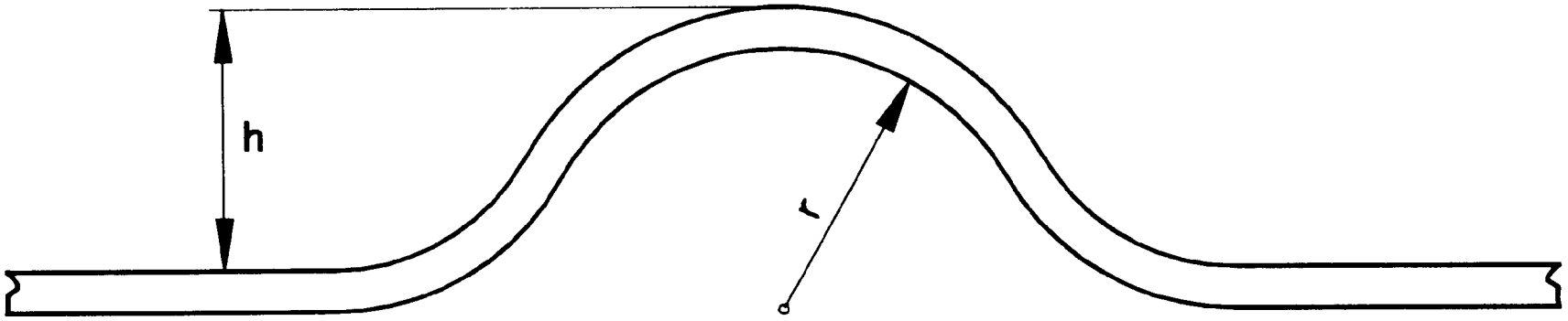
FIG. 6 is a cross-section of a typical V-rib design.

FIG. 4 is a diagrammatic plan view of one side of a single plate where the ribs 48 protruding upwardly are represented by the solid lines and the ribs 50 protruding downwardly are represented by the dash lines. FIG. 5 shows two stacked plates and illustrates that all of the plates are identical and are stacked with the ribs on one plate aligned with the ribs on the adjacent plate. FIG. 6 is a cross section of a rib taken along line 6—6 of FIG. 4 which shows the preferred shape and basic dimension of the ribs. The basic geometry parameters of the invention are indicated in these FIGS. 3, 4 and 6 in which:

Plate Spacing=H

Rib Height=h

Rib Radius=r

Relative Rib Height=h/H

Pitch of Notches=Pn

Pitch of Ribs=Pr

Relative Rib Pitch=Pr/h

Rib Angle=$\Theta$

V-Rib Length=2W

Aspect Ratio=W/H

The ranges for the most relevant parameters and ratios of the invention are as follows:

$0.1 \leqq h/H \leqq 0.4$ $8 \leqq Pr/h \leqq 50$ $15° \leqq \Theta \leqq 45°$

The length of each V-section of the rows of V-shaped ribs, 2W, is a function of the plate separation, H. The range for the invention is:

$0.5H < W < 4H$

Ideally, W is equal to H. As one specific example of a typical arrangement, the dimensions may be as follows:

H=6 mm

Pr=30 mm

Pr/H=5

$\Theta$=45° h=0.6 mm h/H=0.1

W=6 mm

W/H=1.0

Pr/h=50

In the present invention, the multiple V-shaped ribs establish a series of parallel longitudinal vortices which provide a significant average heat transfer increase with a relatively small penalty for increases in pressure drop. The longitudinal vortices have their axes of rotation aligned with the mean flow through the channels between the plates. As a consequence, the fluid velocity at a point located off the axis of rotation has an angle to the mean flow direction. For these parallel vortices to exist, adjacent vortices must be counter rotating. Otherwise, the vortices would act against each other in the plane at the middle of their axes of rotation. Prior plate designs produced turbulence at each plate face but there was no specific design of the plate geometry which coupled the fluid action on both plates to create an advantageous flow pattern.

Figure 7:
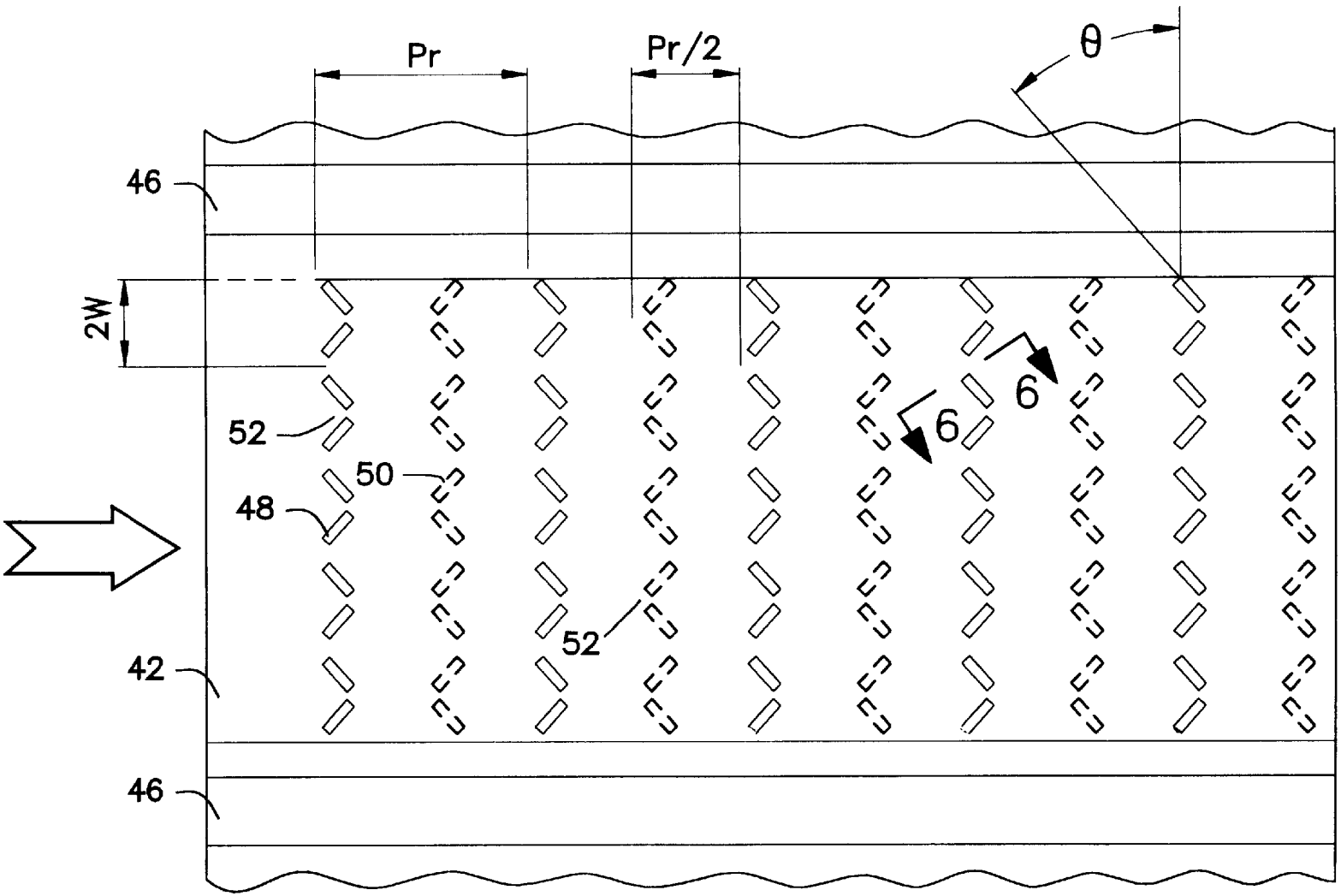
FIG. 7 is a view similar to FIG. 4 illustrating a variation of the invention.
Figure 8:
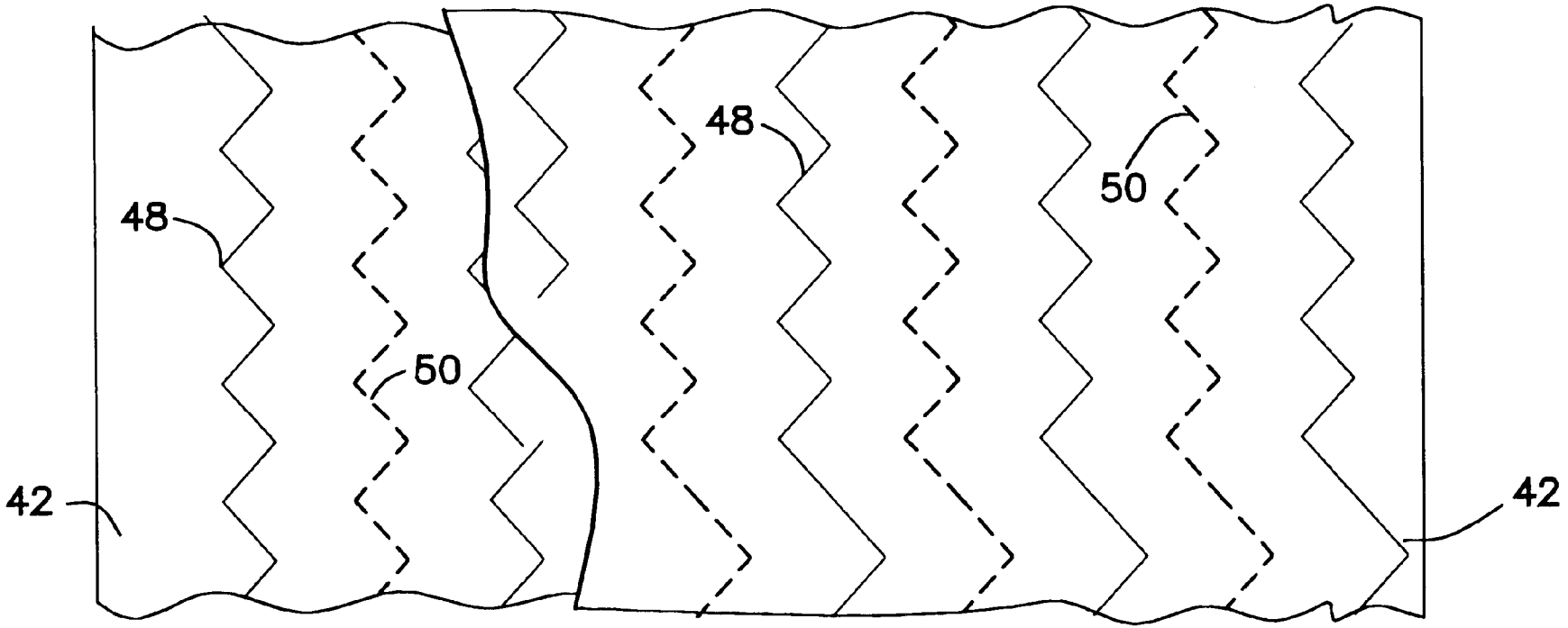
FIG. 8 is a top view of two plates with the top plate partially broken away showing a further variation of the invention.

Another embodiment of the invention is shown in FIG. 7 in which the ribs are discontinuous at the peaks of the V-shape thus providing gaps 52 between each section of the V-shaped ribs 48 and 50. In the manufacturing process, the gaps will cause less strain in the metal when the multiple V-shaped ribs are formed. Also, the gaps 52 can be used for lining up the stacked heat transfer plates 42 in the direction perpendicular to the main gas flow by providing positioning points for the notches 46. A further embodiment is shown in FIG. 8 where the pattern of the intruding ribs 50 is in the same orientation as the pattern of the protruding ribs 48 on that plate rather than reversed or flipped as in FIGS. 3, 4 and 7. Although all the plates may be the same, every other plate is turned 180° in the plane of the plate resulting in the arrangement shown by the two plates in FIG. 8. As can be seen, the rows of protruding ribs on the top of the bottom of the two plates are essentially aligned with the rows of ribs protruding on the top of the top plate except that the V's are flipped 180°. This pattern gives better heat transfer enhancement per unit pressure drop than the arrangement shown in FIGS. 3 and 4. This is because the valley of a rib on a plate lines up with the adjacent ribs upstream and downstream on that plate and thereby causes less pressure drop. The disadvantage is that plates manufactured in a continuous rolling process cannot merely be stacked on top of each other. Every other plate must be rotated 180° before stacking.

What is claimed is:

1. A heat transfer assembly for a rotary regenerative heat exchanger comprising a plurality of heat-absorbent plates each having sides and ends and two opposed planar surfaces and being stacked in spaced relationship thereby providing a plurality of passageways between adjacent plates for flowing a heat exchange fluid therebetween from end-to-end, each of said plates having:

a. means extending from at least one of said opposed planar surfaces forming spacers to engage adjacent plates and maintain said plates spaced apart a distance H; and b. a plurality of spaced apart rows of V-shaped ribs extending from side-to-side on said plate with each row comprising a series of V-shaped rib sections, said rib sections protruding from one of said planar surfaces a distance h which is less than the distance H and with adjacent rows of said plurality of rows protruding from opposed planar surfaces of said plate wherein the range of the ratio h/H is 0.1 to 0.4 and wherein adjacent rows of V-shaped ribs are spaced apart a distance Pr/2 and the range of the ratio Pr/h is 8 to 50 and wherein the length of each V-section of said rows of V-shaped ribs is 2W and wherein the relationship of W to H is $0.5H<W<4H$.

2. A heat transfer assembly as recited in claim 1 wherein the angle of said rib sections with respect to said side-to-side direction is from 15 to 45°.

3. A heat transfer assembly as recited in claim 1 wherein said series of V-shaped rib sections of adjacent rows of said plurality of rows of each plate are oriented in opposite directions.

4. A heat transfer assembly as recited in claim 3 wherein said plurality of plates are identical and wherein said plates are stacked whereby said rows on adjacent plates are aligned with each other and said aligned rows protrude from said adjacent plates in the same direction.

5. A heat transfer assembly as recited in claim 3 wherein each V-shaped rib section comprises two straight sections forming said V shape and further including gaps in said rows of V-shaped ribs between said V-shaped rib sections and between said straight sections.

6. A heat transfer assembly as recited in claim 1 wherein said series of V-shaped rib sections of adjacent rows of said plurality of rows are oriented in the same direction.

7. A heat transfer assembly as recited in claim 6 wherein said plurality of plates are identical and wherein adjacent plates are rotated 180° whereby V-shaped rib sections of adjacent plates are oriented in opposite directions.

8. A heat transfer assembly as recited in claim 7 wherein said rows on adjacent plates are aligned with each other and with said aligned rows protruding from said adjacent plates in the same direction.

* * * * *